US005337924A

United States Patent [19]

Dickie

[11] Patent Number: 5,337,924

[45] Date of Patent: Aug. 16, 1994

[54] INTEGRAL PUMP BOTTLE

[75] Inventor: Robert G. Dickie, Newmarket, Canada

[73] Assignee: Conros Corporation, Scarborough, Canada

[21] Appl. No.: 28,076

[22] Filed: Mar. 8, 1993

[51] Int. Cl.[5] ..... B65D 83/00

[52] U.S. Cl. ..... 222/212; 222/215; 215/1 C

[58] Field of Search ..... 220/669, 670, 675; 215/1 C; 222/206, 212, 215

[56] References Cited

U.S. PATENT DOCUMENTS

| | | | |
|---|---|---|---|
| 1,188,067 | 6/1916 | Greer | 222/212 |
| 1,507,399 | 9/1924 | McCormick | 222/206 |
| 2,864,367 | 12/1958 | Mende | 222/212 X |
| 3,201,111 | 8/1965 | Afton | 215/1 C X |
| 3,325,031 | 6/1967 | Singier | 222/215 X |
| 3,483,908 | 12/1969 | Donovan | 220/675 X |
| 4,261,482 | 4/1981 | Yamada et al. | 222/215 |
| 4,773,458 | 9/1988 | Touzani | 215/1 C X |
| 4,787,536 | 11/1988 | Widerström | 222/212 |
| 4,898,306 | 2/1990 | Pardes | 222/206 |

FOREIGN PATENT DOCUMENTS

| | | | |
|---|---|---|---|
| 0068055 | 6/1951 | Netherlands | 222/206 |

*Primary Examiner*—Andres Kashnikow
*Assistant Examiner*—Anthoula Pomrening
*Attorney, Agent, or Firm*—Jeffrey T. Imai; Arne I. Fors; D. Doak Horne

[57] ABSTRACT

A bottle for storing and dispensing viscous liquids comprises a bottom, sides, a face having a substantially uniform wall thickness and a closable top. The bottle is integrally molded from an olefin material. The face has a pump integrally molded therein. The pump comprises at least one endless ridge defining a valley. The valley has a wall thickness of about 40% of the wall thickness of the face.

3 Claims, 3 Drawing Sheets

INTEGRAL PUMP BOTTLE

FIELD OF INVENTION

This invention relates to a flexible bottle container having an integral pump. In particular, this invention relates to a bottle container having a pump integrally molded therein.

BACKGROUND OF INVENTION

Many liquid or viscous products, such as glues, hand lotions, shampoos, food products such as ketchup, mustard and sauces are bottled in plastic containers or bottles. Plastic provides a lightweight inexpensive method of marketing a product.

To extract product from conventional containers, the user generally turns the bottle over allowing the force of gravity to draw the liquid out the opening. To enhance the pourability of some bottles, the front and rear surfaces of the bottle are made thinner or more flexible than the sides or edges of the bottle, permitting the bottle to be squeezed, urging the contents out. The squeezability of the bottle is normally a key marketing feature. However, many small children and elderly persons find squeezing a regular squeezable bottle difficult. Some children have a tendency to over-squeeze the bottle spilling the contents of bottle.

In order to overcome this problem, producers of liquid or viscous products have used pumps mounted in the mouth of the bottle. Many types of pump nozzles are well known in the art, including the pumps disclosed in the following U.S. Pat. Nos.: 4,120,429, 4,120,430, 4,352,443, 4,606,477, 4,863,070. However, the cost of such pumps detract from the potential marketing gain.

SUMMARY OF THE INVENTION

The disadvantages of the prior art may be overcome by providing a flexible or semi-rigid bottle having an integrally molded pump.

According to one aspect of the invention, there is provided a bottle for storing and dispensing viscous liquids. The bottle is blown from an olefin material. The bottle comprises a bottom, sides, at least one face having a substantially uniform wall thickness and a closable top. The face has a pump integrally molded therein. The pump comprises at least one endless recess defining a valley. The valley has a wall thickness of about 40% of the wall thickness of the face.

DESCRIPTION OF THE DRAWINGS

In figures which illustrate embodiments of the invention.

DESCRIPTION OF THE INVENTION

Figure 1:
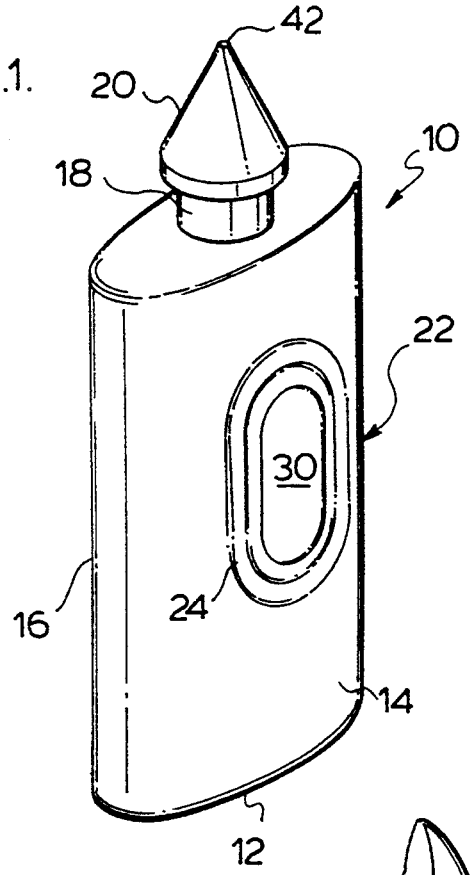
FIG. 1 is a perspective view of a bottle according to the present invention.
Figure 2:
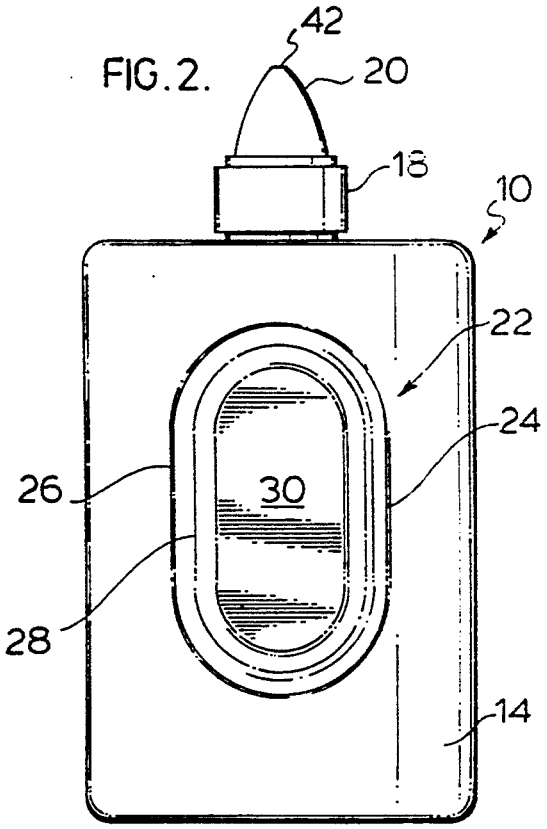
FIG. 2 is a front elevational view of the invention of FIG. 1.
Figure 3:
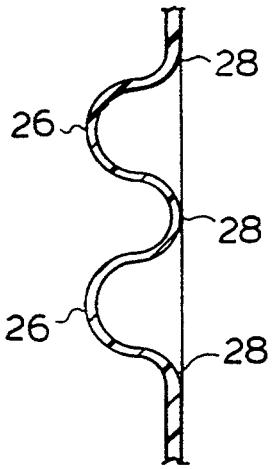
FIG. 3 is a sectional view of the integral pump of the invention of FIG. 1.
Figure 4:
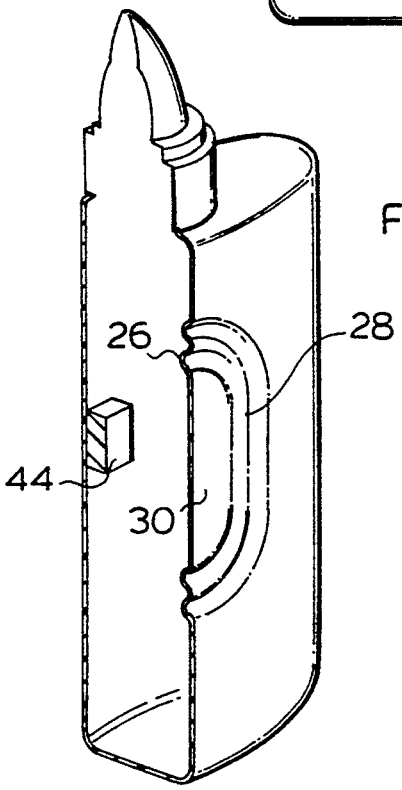
FIG. 4 is a perspective sectional view of the invention of FIG. 1 along a central longitudinal axis.

The bottle of the present invention is generally illustrated in FIG. 1 as 10. Bottle 10 has a bottom 12, a pump face 14, an opposing face 16 and a closable top 18. Closable top 18 has a suitable closable cap 20 for dispensing the liquid or viscous contents of bottle 10.

On pump face 14, a pump 22 is integrally molded therein. Pump 22 is a series of recesses 24 defined by valleys 26 and crests 28. Valleys 26 have a wall thickness which is less than the thickness of the crests 28 and the pump face 14. Since the crest and valleys are thinner than the pump face, the valleys are more flexible than the face, allowing pad 30 to move back and forth relative to the opposing face 16 with less force than without the pump.

Recesses 24 are preferably formed in an endless loop shape. As illustrated in FIG. 1, recesses 24 are oval shaped. Satisfactory results could be obtained from other shapes including circles.

Figure 5:
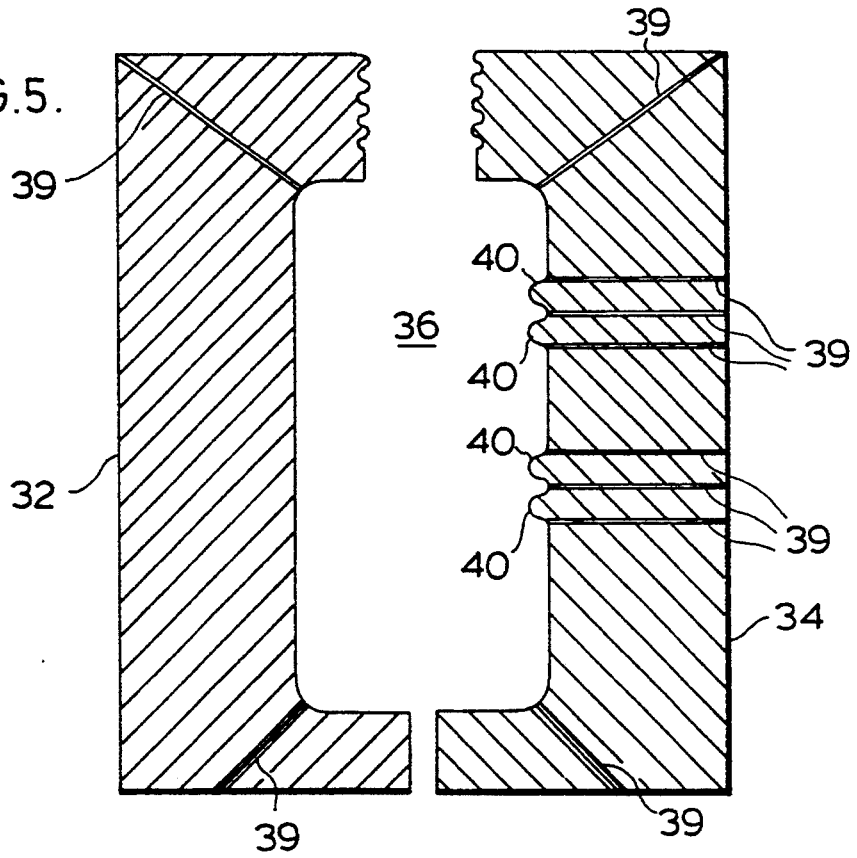
FIG. 5 is a sectional view of a mold for manufacturing the invention of FIG. 1.
Figure 6:
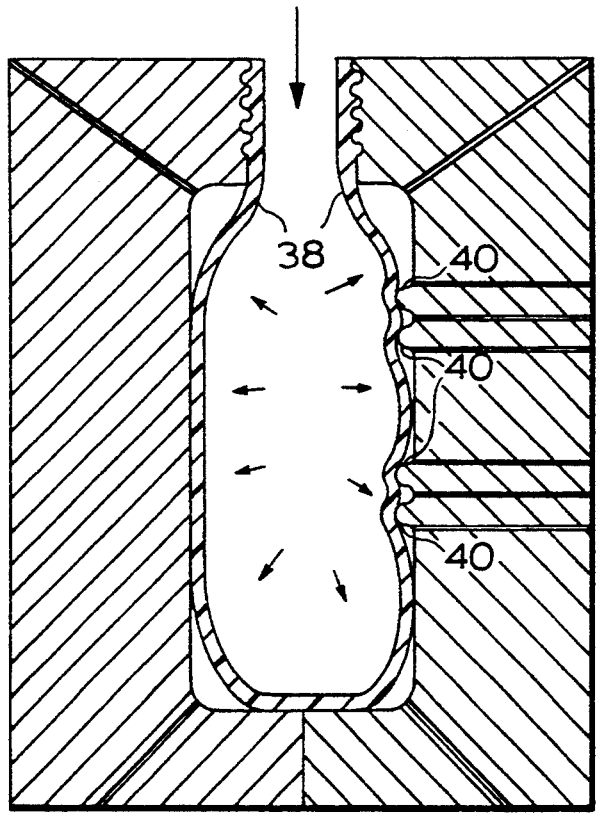
FIG. 6 is a sectional view of a mold for manufacturing the invention of FIG. 1 with a preform being blown into a bottle.
Figure 7:
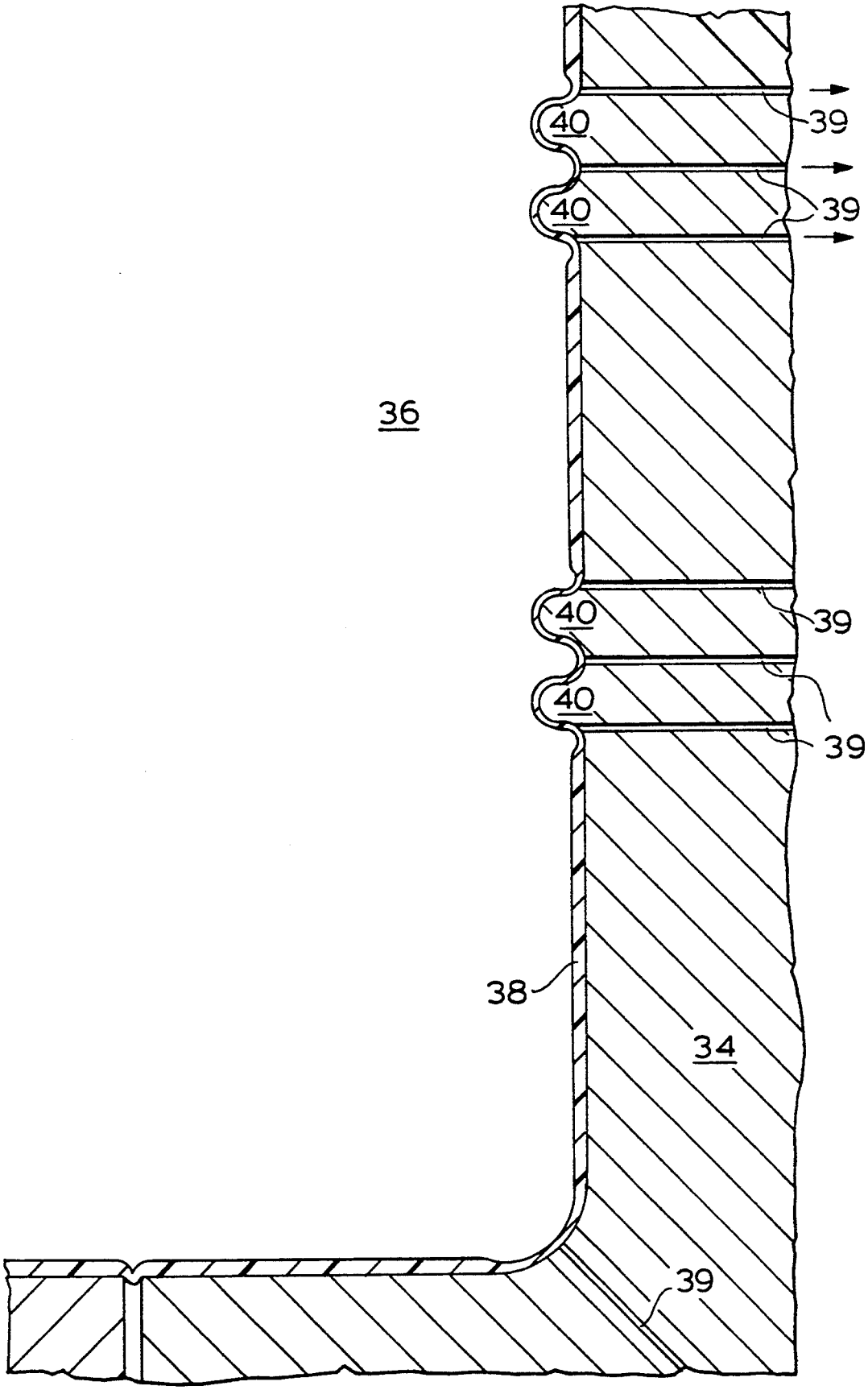
FIG. 7 is a detailed sectional view of a mold for manufacturing the invention of FIG. 1 with a bottle being blown.

Referring to FIGS. 5 and 6, molds 32 and 34 are used to define mold cavity 36. Half mold 34 has a mold surface having a shape complementary to pump face 14. Mold 34 has a series of ridges 40 complimentary to the series of recesses 24 for defining valleys 26 and crests 28 to be formed in the blown bottle. The ridges extend inwardly into the mold cavity 36.

Referring to FIGS. 5 and 6, recesses 24 are formed during a blow molding process. The two molds 32 and 34 are brought together defining mold cavity 36. A preform of molding material 38 is placed within the cavity 36 of the mold. The preform 38 is heated and blown until the molding material contacts the surface of the cavity, conforming to the inside surface thereof.

As the molding material is heated and blown, the preform of molding material 38 contacts the surface of the cavity, first contacting the peak of ridges 40. It is well known in the art of blow molding that the molding material will stick to the mold surface. The molding material will stretch only where it does not contact the mold surface. Air pressure from inside the preform 38 will then stretch the material over the ridges 40 forming crests 28 into the pump face 14 of bottle being molded. The action of the air pressure stretches the molding material into the side walls of valleys 26, thinning the walls of the valleys 26.

To ensure that molding material fully contacts the mold surface, vent holes 39 are provided. Vent holes 39 extend into each corner of the mold. In particular, the vents 39 extend into the base of ridges 40. A vacuum can be applied to the vent holes 39 to assist the drawing of the molding material into full contact with the mold surface.

The amount of stretch and hence the thinning can be calculated as a function of the distance between crests 28 and the depth of the valleys 26 relative to the thickness of the pump face. In the preferred embodiment, the thickness of the walls of the valleys 26 is between 30% and 60% of the thickness of the pump face 14. The preferred thickness is about 40% of the thickness of the pump face 14.

The molding material can be any suitable thermoplastic material, with the preferred material being polyethylene, either high or low density.

In use, the bottle 10 is filled with a liquid or viscous substance. The bottle is then capped, packaged, labelled and shipped. To extract the contents, the cap is opened and the bottle inverted allowing gravity to initially draw the liquid or viscous substance to the pour spout 42. The user squeezes the bottle by pressing on pad 30 urging the pad towards the opposing face 16. Since recesses 24 are more flexible than the remainder of the bottle 10, generally only pad 30 will move relative to the rear wall 16 urging the contents out of the bottle 10. Once pad 30 has travelled enough to eject the contents in the amount selected by the user, the user eases up on the pad, allowing the pad 30 to expand sucking back air through spout 42, ready for re-use.

Optionally, the distance of the movement of pad 30 can be limited such that a metered amount of liquid or viscous substance is urged from the bottle 10. The area of the pad and the distance of travel can easily be calculated to estimate the amount of liquid being forced out. A stop 44 could be molded into the interior surface of opposing face 16 to restrict the throw of pad 30. The user can repeatedly squeeze the bottle at pad 30 until it contacts the stop 44, the same approximate amount of liquid or viscous substance is ejected each time.

It is now apparent to a person skilled in the art that numerous products could be packaged using the present invention. However, since many other modifications and purposes of this invention become readily apparent to those skilled in the art upon perusal of the foregoing description, it is to be understood that certain changes in style, size and components may be effective without a departure from the spirit of the invention and within the scope of the appended claims.

I claim:

1. A bottle for storing and dispensing viscous liquids, said bottle blow molded from an olefin material and comprising a bottom, sides, a substantially planar pump face having a substantially uniform wall thickness, a closable top and a stop means, said face having a pump means integrally molded therein, said pump means comprising at least one endless ridge defining a valley surrounding a planar pad, said valley having a wall thickness of between 30% and 60% of said wall thickness of said face for facilitating reciprocal movement of said pad between a first position substantially co-planar with said pump face and a second position adjacent said stop means, whereby movement of the pad to the stop means is capable of urging metered amounts of viscous liquids out of the bottle.

2. A bottle as claimed in claim 1 wherein said stop means is molded to an inside surface of an opposing face opposite said face.

3. A bottle as claimed in claim 1 wherein said valley wall thickness is about 40%.

* * * * *